US007254347B2

(12) United States Patent
Matsumoto et al.

(10) Patent No.: US 7,254,347 B2
(45) Date of Patent: Aug. 7, 2007

(54) ELECTROPHOTOGRAPHIC IMAGE FORMING APPARATUS AND UNIT

(75) Inventors: Hideki Matsumoto, Mishima (JP); Masaki Ojima, Mishima (JP); Kenji Matsuda, Numazu (JP); Minoru Matsuguma, Susono (JP); Katsuhiro Kojima, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 291 days.

(21) Appl. No.: 11/152,563

(22) Filed: Jun. 14, 2005

(65) Prior Publication Data

US 2005/0276617 A1 Dec. 15, 2005

(30) Foreign Application Priority Data

Jun. 15, 2004 (JP) ..... 2004-176468
May 30, 2005 (JP) ..... 2005-156876

(51) Int. Cl.
*G03G 15/00* (2006.01)

(52) U.S. Cl. ..... 399/13

(58) Field of Classification Search ..... 399/9, 399/12, 36, 159, 167
See application file for complete search history.

(56) References Cited

U.S. PATENT DOCUMENTS 6,311,026 B1 * 10/2001 Higeta et al. ..... 399/13
7,082,275 B2 * 7/2006 Portig et al. ..... 399/110
7,130,548 B2 * 10/2006 Uchida ..... 399/12
2006/0233557 A1 * 10/2006 Eom ..... 399/12

FOREIGN PATENT DOCUMENTS

JP 9-160469 A 6/1997

* cited by examiner

*Primary Examiner*—Hoan Tran
(74) *Attorney, Agent, or Firm*—Canon U.S.A. Inc. I.P. Div

(57) ABSTRACT

A unit includes cartridge electrical contacts provided at respective ends of the cartridge in a longitudinal direction and electrically connecting with body electrical contacts when the cartridge is properly mounted to the image forming apparatus. The cartridge electrical contacts are electrically connected to each other. Mounting the cartridge to the image forming apparatus forms a detection circuit via the cartridge.

16 Claims, 17 Drawing Sheets

FIG. 10

| | R1 | R2 | R3 | R4 | | R0 | CURRENT VALUE |
|---|---|---|---|---|---|---|---|
| RESISTANCE(Ω) | 10 | 20 | 40 | 80 | | 160 | |
| STATE 1 | 0 | 0 | 0 | 0 | | 160 | 0.3125 |
| STATE 2 | 0 | 0 | 0 | 80 | | 160 | 0.9375 |
| STATE 3 | 0 | 0 | 40 | 0 | | 160 | 1.5625 |
| STATE 4 | 0 | 20 | 0 | 0 | | 160 | 2.8125 |
| STATE 5 | 10 | 0 | 0 | 0 | | 160 | 5.3125 |
| STATE 6 | 10 | 20 | 0 | 0 | | 160 | 7.8125 |
| STATE 7 | 10 | 0 | 40 | 0 | | 160 | 6.5625 |
| STATE 8 | 10 | 0 | 0 | 80 | | 160 | 5.9325 |
| STATE 9 | 0 | 20 | 40 | 0 | | 160 | 4.0625 |
| STATE 10 | 0 | 20 | 40 | 80 | | 160 | 3.4375 |
| STATE 11 | 0 | 0 | 40 | 80 | | 160 | 2.1875 |
| STATE 12 | 10 | 20 | 40 | 0 | | 160 | 9.0625 |
| STATE 13 | 10 | 20 | 0 | 80 | | 160 | 8.4375 |
| STATE 14 | 10 | 0 | 40 | 80 | | 160 | 7.1875 |
| STATE 15 | 0 | 20 | 40 | 80 | | 160 | 4.6875 |
| STATE 16 | 10 | 20 | 40 | 80 | | 160 | 9.6875 |

FIG. 12A

BLACK CARTRIDGE IS NOT MOUNTED
OR IS NOT MOUNTED PROPERLY !

FIG. 12B

YELLOW CARTRIDGE IS MOUNTED WHERE
BLACK CARTRIDGE SHOULD BE MOUNTED !

FIG. 12C

CARTRIDGE IS NOT MOUNTED OR
IS NOT MOUNTED PROPERLY !

ELECTROPHOTOGRAPHIC IMAGE FORMING APPARATUS AND UNIT

BACKGROUND OF THE INVENTION

1. Field of the Invention

The present invention relates to an electrophotographic image forming apparatus for forming an image on a recording medium, and a unit removable from the electrophotographic image forming apparatus.

2. Description of the Related Art

An electrophotographic image forming apparatus forms an image on a recording medium (such as a recording sheet or an OHP sheet) by using an electrophotographic image forming method. Examples of the electrophotographic image forming apparatus include an electrophotographic copying machine, an electrophotographic printer (such as a laser beam printer and a LED printer), a facsimile machine, and a word processor.

A unit refers to a cartridge which is removable from the body of the electrophotographic image forming apparatus. The cartridge is an integral structure of an electrophotographic photosensitive drum and at least one of a processing unit, a charging unit, a developing unit, and a cleaning unit. A unit also refers to, for example, a single electrophotographic photosensitive drum, a processing unit, or a fixing unit, which is removable from the body of the electrophotographic image forming apparatus.

In the past, an electrophotographic image forming apparatus performing an electrophotographic image forming process has used a cartridge method which allows a process cartridge (serving as a unit) having an electrophotographic photosensitive member and a processing unit (which acts on the electrophotographic photosensitive drum) integrally formed with each other to be removable from the body of the image forming apparatus. When such a cartridge method is used, the apparatus can be maintained by a user without the help of a service personnel, so that the operability of the apparatus is considerably enhanced. Therefore, such a cartridge method is widely used in the electrophotographic image forming apparatus.

When the user replaces such a process cartridge, the user may replace the process cartridge by moving it in a way that is not necessarily conceived by the manufacturer. Therefore, a guide is disposed at the body of the image forming apparatus so that the process cartridge is mounted to the body of the image forming apparatus along a predetermined path.

However, when the process cartridge is mounted at an unexpected angle or with an unexpected mounting force, the process cartridge may not be properly mounted to the body of the image forming apparatus.

Therefore, a proposal for detecting whether or not the process cartridge or the like is properly mounted to the body of the image forming apparatus has been made.

For example, in Japanese Patent Laid-Open No. 9-160469, when process cartridges are all mounted to a tandem color image forming apparatus to which more than one process cartridge can be mounted, a detection circuit is formed via the process cartridges in order to detect the mounting of the process cartridges.

However, in the detection circuit, connection of contacts of the process cartridges and contacts of the apparatus body and connection of the contacts of the process cartridges that are adjacent to each other are achieved at the process cartridges at one end in a longitudinal direction. That is, strictly speaking, the mounting state of the process cartridges at the other end in the longitudinal direction and the state of connection of drive members of the apparatus body and drive members of the process cartridges are not detected.

SUMMARY OF THE INVENTION

The present invention is directed to a unit whose proper mounting state with respect to an electrophotographic image forming apparatus can be detected using a simple structure.

In an electrophotographic image forming apparatus in which more than one unit can be mounted, the present invention is also directed to units whose proper mounting states with respect to the electrophotographic image forming apparatus can be detected using a simple structure.

The present invention is also directed to a unit whose mounting state with respect to an electrophotographic image forming apparatus and an engagement state of a drive member of the apparatus with a drive force transmission member of the unit can be detected using a simple structure. The present invention is also directed to an electrophotographic image forming apparatus incorporating the above-mentioned units.

In one aspect of the present invention, a unit which is removably mounted from an electrophotographic image forming apparatus for forming an image on a recording medium and which includes a drive force transmission member, a first positioning member, a first unit electrical contact, a second positioning member, and a second unit electrical contact. The drive force transmission member transmits a drive force to the unit from a body drive member of the apparatus body as a result of engagement of the drive force transmission member with the body drive member. The first positioning member is provided at a first end of the unit in a longitudinal direction thereof for positioning the unit to the apparatus when the unit is mounted to the apparatus. The first unit electrical contact is provided at the first end, and electrically connects with a first body electrical contact of the apparatus when the first positioning member is mounted to the apparatus. The second positioning member is provided at a second end of the unit in the longitudinal direction thereof for positioning the unit to the apparatus and when the unit is to be mounted to the apparatus. The second unit electrical contact is provided at the second end and electrically connects with the first unit electrical contact. The second unit electrical contact electrically connects with a second body electrical contact of the apparatus when the second positioning member is mounted to the apparatus. An electrical connection state between the first unit electrical contact and the second unit electrical contact is detected through the first body electrical contact and the second body electrical contact with a body detecting unit of the apparatus.

According to another aspect of the present invention, an electrophotographic image forming apparatus from which a unit is removably mounted and for forming an image on a recording medium. The apparatus includes (i) a first body electrical contact, (ii) a second body electrical contact, (iii) a body drive member for transmitting a drive force to the unit, (iv) a first body positioning member for positioning the unit at the body of the electrophotographic image forming apparatus, (v) a second positioning member for positioning the unit with respect to the electrophotographic image forming apparatus, (vi) a mounting member for removably mounting the unit which includes a drive force transmission member, a first positioning member, a first unit electrical contact, a second positioning member, and a second unit electrical contact, the drive force transmission member transmitting a drive force to the unit from the body drive member as a result of engagement of the drive force transmission member with the body drive member, the first positioning member being provided at a first end of the unit in a longitudinal direction thereof and for positioning the unit with respect to the apparatus when the unit is mounted to the apparatus, the first unit electrical contact being provided at the first end and electrically connected with the first body electrical contact when the first positioning member is mounted to the apparatus, the second positioning member being disposed at a second end of the unit in the longitudinal direction thereof for positioning the unit at the apparatus when the unit is mounted to the apparatus, the second unit electrical contact being provided at the second end and electrically connecting with the first unit electrical contact, the second unit electrical contact electrically connecting with the second body electrical contact when the second positioning member is mounted to the apparatus, and (vii) a body detecting member for detecting that the unit is mounted to the apparatus by detecting an electrical connection state between the first unit electrical contact and the second unit electrical contact through the first body electrical contact and the second body electrical contact.

Further features and advantages of the present invention will become apparent from the following description of exemplary embodiments with reference to the attached drawings.

BRIEF DESCRIPTION OF THE DRAWINGS

FIG. 10 shows examples of resistance values, applied voltage values, and detection current values.

FIGS. 12A to 12C show examples of warning displays.

DESCRIPTION OF THE EMBODIMENTS

First Embodiment

An image forming apparatus, units, and a detection system in accordance with a first embodiment of the present invention will be described. The image forming apparatus according to the embodiment is a laser beam printer which receives image information from, for example, an external host computer or network and outputs an image on a sheet which is a recording medium. Process cartridges can be replaced by being removed from the body of the image forming apparatus.

[Schematic Description of Process Cartridges]

Figure 2A:
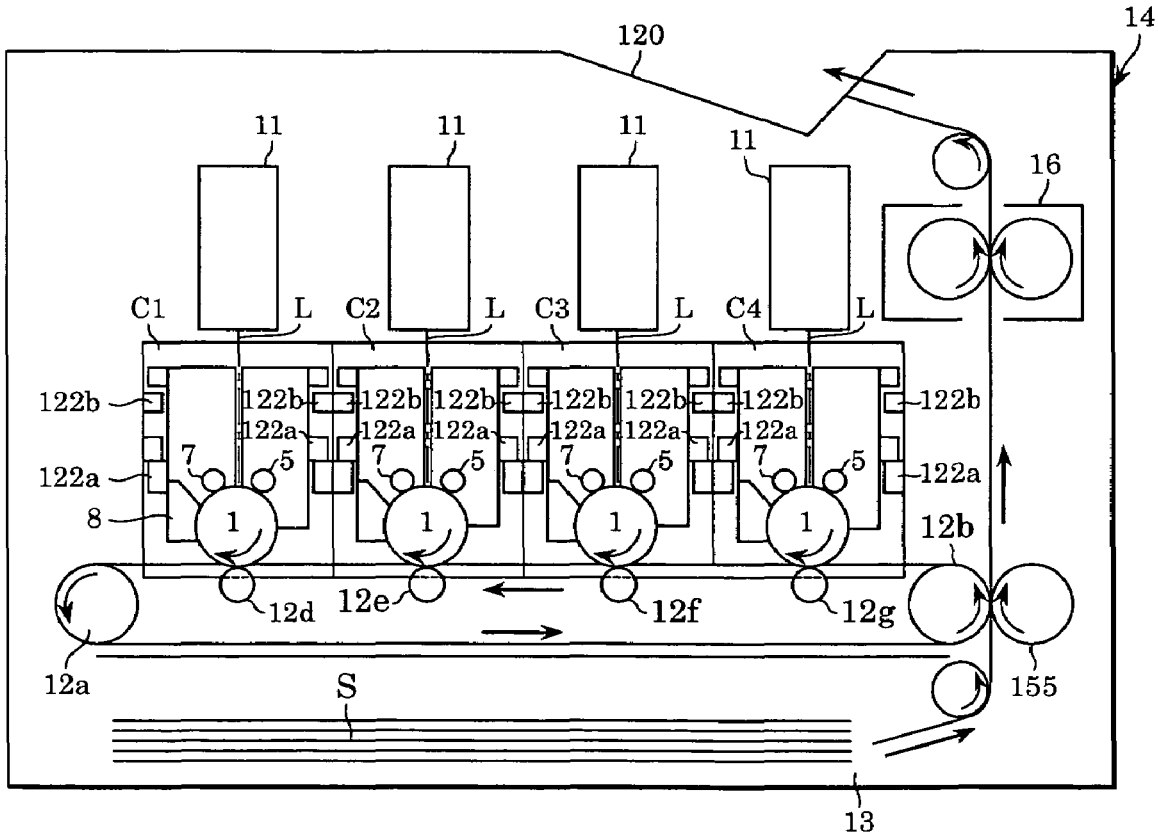
FIGS. 2A and 2B schematically show process cartridges and a laser beam printer.

FIG. 2A schematically shows the structure of an electrophotographic image forming apparatus 14 and process cartridges C1 to C4 (hereafter sometimes referred to as the "cartridges C") serving as units that are removable from the electrophotographic image forming apparatus 14. Each cartridge C is an integral structure including a photosensitive drum 1 (which is a latent image carrier), a charging roller 7 for uniformly charging the photosensitive drum 1, a developing roller 2 for developing an electrostatic latent image formed on the peripheral surface of the photosensitive drum 1, a toner container 4 containing a developer (hereafter referred to as "toner") used by the developing roller 2, a blade 8 for removing the toner remaining on the peripheral surface of the photosensitive drum 1, and a waste toner container 9 for containing the toner removed by the blade 8.

[Schematic Description of Image Forming Apparatus]

The cartridges C for respective four colors (black, cyan, magenta, and yellow) are removable from the electrophotographic image forming apparatus 14 (hereafter referred to as the "image forming apparatus 14") shown in FIG. 2A. In other words, each cartridge C can be mounted to the image forming apparatus 14 so as to be removable therefrom in a longitudinal direction by its associated mounting members 122*a* and 122*b*. Laser scanners 11 for performing irradiation with laser beams L in correspondence with image information are disposed at the upper portion of the image forming apparatus 14. A transferring unit 12 opposing the photosensitive drums 1 is disposed under the cartridges C at the lower portion of the image forming apparatus 14. In this structure, the photosensitive drums 1 are uniformly charged with the respective charging rollers 7 in order to irradiate and expose their peripheral surfaces with the laser beams L from the laser scanners 11. Electrostatic latent images corresponding to image information are formed on the peripheral surfaces of the photosensitive drums 1. The electrostatic latent images are made visible as toner images by adhering toner T in the toner containers 4 to the electrostatic latent images by development bias applied to the developing rollers 2. The development bias is a DC bias. The transferring unit 12 in the embodiment includes an intermediate transfer belt (transportation belt) 12*c* for successively superposing and transferring the toner images formed on the respective photosensitive drums 1 thereto, rollers 12*a* and 12*b* for rotationally driving the transportation belt 12*c*, and transfer rollers 12*d* to 12*g* for transferring the toner images onto the intermediate transfer belt 12*c* from the photosensitive drums 1. A transfer roller 155 transfers the toner images that are on the intermediate transfer belt 12*c* onto a sheet S fed from a cassette 13 disposed at the lower portion of the image forming apparatus 14. Thereafter, the sheet S is transported upward, the toner images are fixed to the sheet S by a fixing unit 16, and then the sheet S is discharged to a tray 120.

[Schematic Description of Detection System]

Figure 1A:
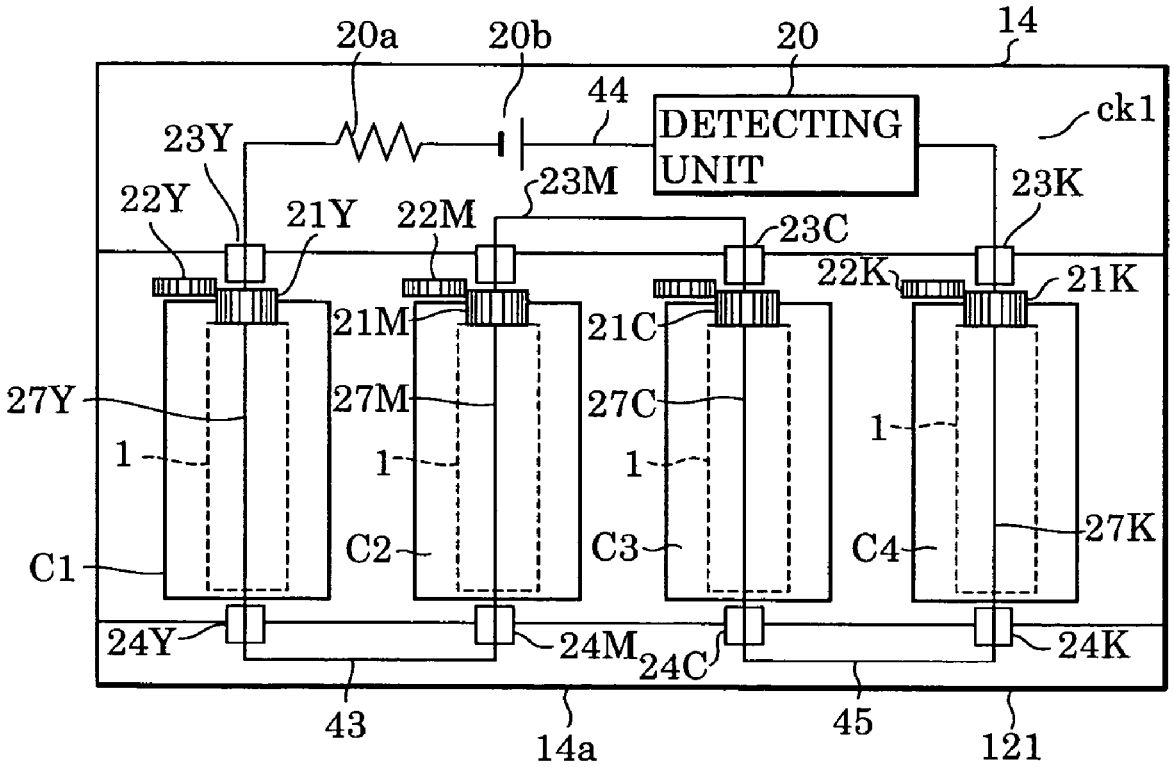
FIGS. 1A to 1C schematically show a detection system.

FIG. 1A is a schematic view of a detection system in accordance with a first embodiment of the present invention. In the embodiment, the detection system, serving as an example of a connection state detecting unit, has a detection circuit formed in each unit in the image forming apparatus 14. A detection circuit CK1 is a circuit in which a detecting unit 20, a resistor 20*a*, a power supply 20*b*, and the cartridges C are connected in series when all of these components are mounted to the image forming apparatus 14.

As shown in FIG. 1A and FIG. 2, the cartridges C can be removed from the image forming apparatus 14 by being guided by the mounting members 122*a* and 122*b*. Here, a side where drive gears 21 are disposed in the longitudinal direction of the cartridges C is called a drive side (one side) and a side substantially opposite to the drive gears 21 is called a non-drive side (other side). Hereunder, the non-drive side refers to not only an edge of each cartridge C, but also a range including a side surface thereof.

Figure 1B:
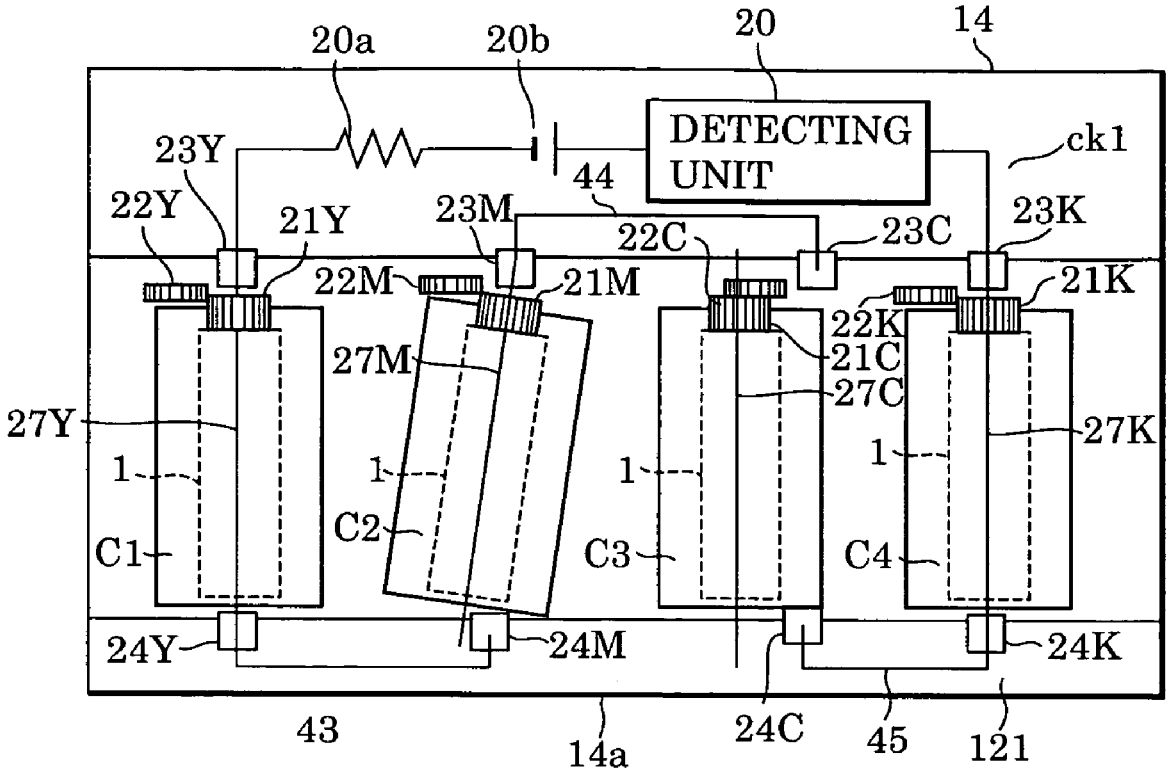
Figure 1C:
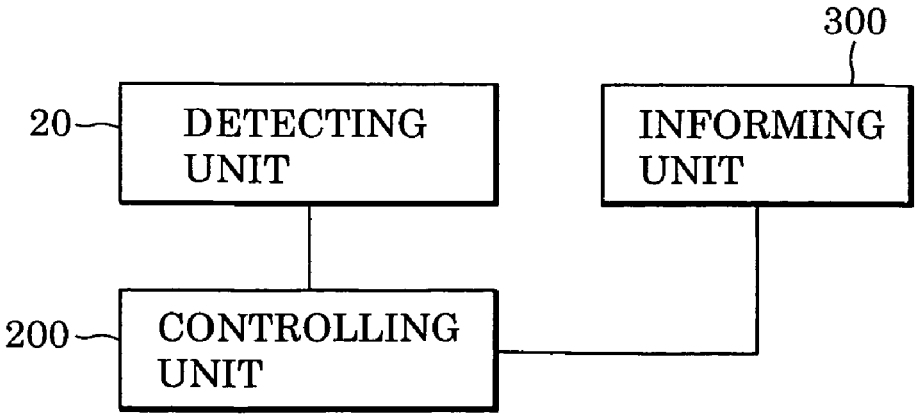
Figure 2B:
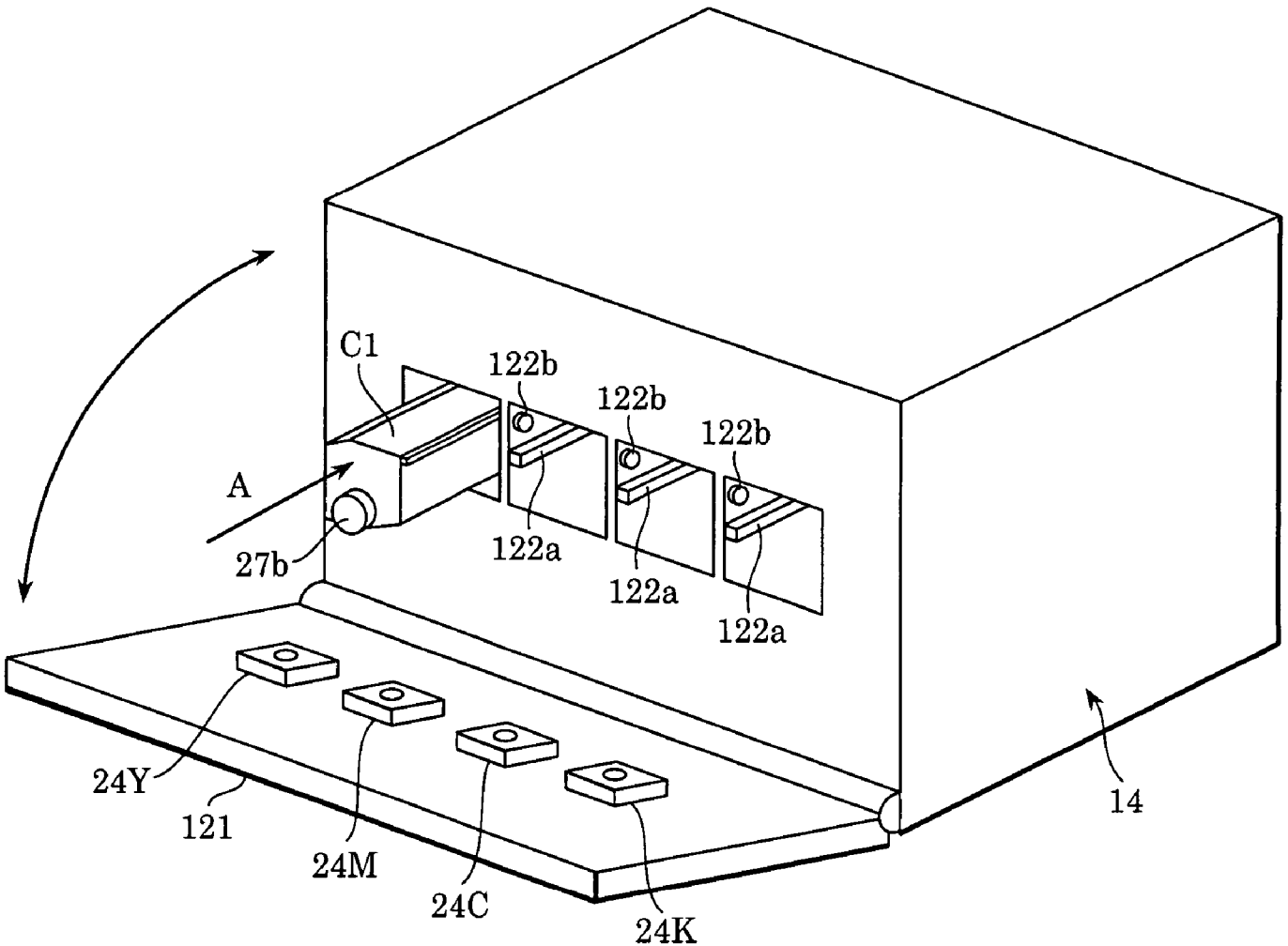

As shown in FIG. 2B, each cartridge C is inserted into the image forming apparatus 14 in the direction of arrow A. As shown in FIGS. 1 to 3, this causes holes 23*b* of positioning members 23 (23Y, 23M, 23C, and 23K) of the image forming apparatus 14 and shaft ends 27*a* at the drive side of the cartridges C to be fitted together. Next, by closing an opening-and-closing cover 121 rotatably disposed at the image forming apparatus 14, holes 24*b* of positioning members 24 (24Y, 24M, 24C, and 24K) at the opening-and-closing cover 121 and shaft ends 27*b* at the non-drive side of the cartridges C are fitted together. Therefore, the cartridges C are mounted to, that is, positioned at the image forming apparatus 14.

When the cartridges C are mounted to the image forming apparatus 14, drive gears 22 (22Y, 22M, 22C, and 22K), serving as body drive members, disposed at the image forming apparatus 14 and the drive gears 21 (21Y, 21M, 21C, and 21K), serving as drive force transmission members, disposed at the respective cartridges C are connected to each other so as to be drivable.

When the cartridges C are properly mounted to the image forming apparatus 14, contacts 23*a*, serving as first body contacts disposed in the positioning members 23, and the ends 27*a* (first unit contacts, see FIG. 3B) of rotational central shafts 27 (hereafter referred to as the "shafts 27") at the cartridges C electrically contact each other. Even at the non-drive side, contacts 24*a* (second body contacts, see FIG. 3C) in the positioning members 24 and the ends 27*b* (second unit contacts) of the shafts 27 at the cartridge C electrically contact each other.

Each shaft 27 is a metallic shaft of its associated photosensitive drum 1. Therefore, conduction is achieved from the first unit contacts to the respective second unit contacts. Consequently, when the four cartridges C are properly mounted to the image forming apparatus 14, a total of eighth contacts are electrically connected. As a result, the detection circuit CK1 shown in FIG. 1A becomes closed, so that a predetermined current flows. The conduction is detected by the detecting unit 20.

FIG. 1B shows a state in which some of the cartridges C are not properly mounted to the image forming apparatus 14. The cartridges C1 to C4 are in the following circuit state. The cartridges C1 and C4 are properly mounted. At the non-drive side, the cartridge C2 is mounted such that the hole 24*b* and the shaft end 27*b* are not adequately fitted together. At the drive side, the cartridge C2 is mounted such that the hole 23*b* and the shaft end 27*a* are not adequately fitted together. At the non-drive side, the cartridge C3 is mounted such that the hole 24*b* and the shaft end 27*b* are not adequately fitted together.

Since the cartridges C2 and C3 are not properly mounted to the image forming apparatus 14, the detection circuit CK1 is not closed. As a result, current does not flow through the detection circuit CK1. Therefore, a controlling unit 200 shown in FIG. 1C, which has received a detection signal from the detecting unit 20, determines that some of the four process cartridges are not properly mounted. In contrast, when the controlling unit 200 confirms electrical conduction, it determines that all of the cartridges C are properly positioned and that the drive gears 21 properly engage the respective drive gears 22.

In the embodiment, the state of engagement of the drive gears of all of the cartridges C and the state of mounting of the cartridges C to the positioning members 23 and 24 are detected at the same time by electrical conduction in the one detection circuit CK1.

[Drive Side of Detection System]

Figure 3A:
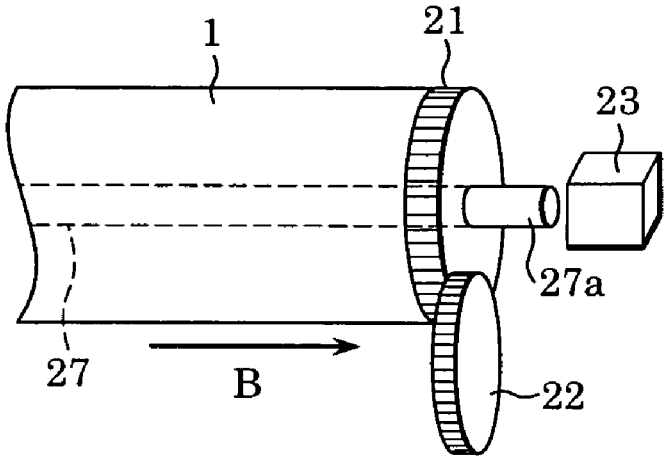
FIGS. 3A to 3D illustrate the vicinity of a connection portion of a unit and an image forming apparatus.
Figure 3B:
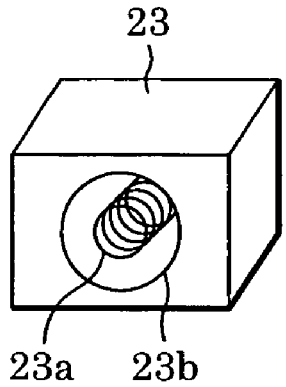

The structure of the drive side of one cartridge used as a representative example will be described. FIGS. 3A and 3B illustrate the drive side of the image forming apparatus 14 and the cartridge C.

As shown in FIG. 3A, the photosensitive drum 1 has the shaft 27. The drive gear 21 is disposed at one end of the photosensitive drum 1 in a longitudinal direction. The drive gear 22 and the positioning member 23 for positioning the shaft 27 are disposed at the image forming apparatus 14.

FIG. 3B is an enlarged view of the positioning member 23 as viewed in the direction of mounting of the cartridge C. The diameter of the hole 23*b* of the positioning member 23 becomes smaller towards the inner side so that the shaft 27 that is inserted into the hole 23*b* is guided towards the central portion of the hole 23*b*. The spring 23*a* serving as an electrical contact is disposed in the center of the hole 23*b*. The spring 23*a* is formed of an electrically conductive material, and is connected to the detection circuit CK1. When the end 27*a* of the shaft 27 and the spring 23*a* contact each other, the shaft 27 is also connected to the detection circuit CK1.

FIG. 3A shows a state in which the drive gears 21 and 22 do not engage each other. When the drive gears 21 and 22 engage each other as a result of movement of the photosensitive drum 1 in its mounting direction (that is, in the direction of arrow B), the end 27*a* of the shaft 27 and the spring 23*a* in the positioning member 23 are disposed at locations that allow them to contact each other.

[Non-Drive Side Portion of Detection System]

Figure 3C:
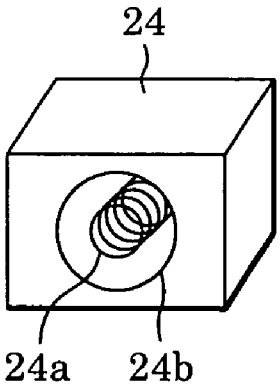
Figure 3D:
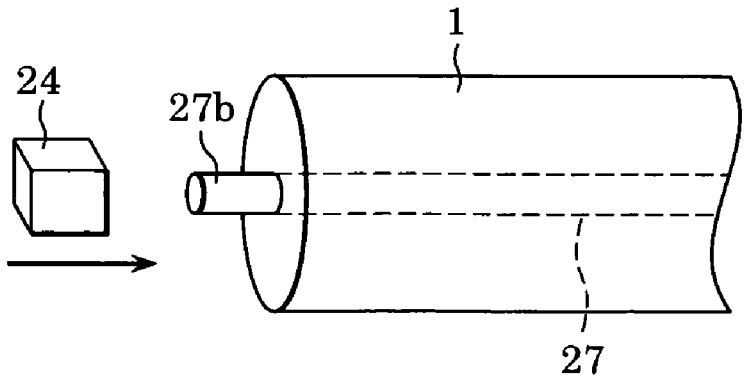

FIGS. 3C and 3D show the vicinity of a connection portion of the unit and the image forming apparatus at the non-drive side. As shown in FIG. 3C, the hole 24*b* of the positioning member 24 becomes narrower towards the inner side like the hole 23*b* of the positioning member 23, and the spring 24*a* serving as the second body contact is disposed in the center of the hole 24*b*. The positioning member 24 moves in the direction of the arrow shown in FIG. 3D in response to the closing operation of the opening-and-closing cover 121 (see FIG. 2B) and is fitted to the shaft 27. The opening-and-closing cover 121 is opened and closed with respect to the image forming apparatus 14 when the cartridge C is mounted. When the opening-and-closing cover 121 starts closing, the positioning member 24 pushes the photosensitive drum 1 towards the drive side. The pushing force engages the drive gears 21 and 22 in order to help the shaft 27 and the springs 23*a* and 24*a* to contact each other.

When the end 27*b* of the shaft 27 and the spring 24*a* are in contact with each other, the shaft 27 is also connected to the detection circuit CK1. As shown in FIG. 1A, conducting members 43 and 45 which connect two adjacent springs 24*a* are disposed at the opening-and-closing cover 121. Closing the opening-and-closing cover 121 causes adjacent cartridges, that is, the cartridges C1 and C2 and the cartridges C3 and C4 to be electrically connected by the conducting members 43 and 45.

A conducting member 44 which connects two adjacent springs 23*a* is disposed at the drive side of the image forming apparatus. Therefore, the cartridges C2 and C3 are electrically connected by the conducting member 44. In other words, in FIG. 1, the spring 23*a* of the positioning member 23Y and the spring 23*a* of the positioning member 23K are electrically connected in series.

[Detection Timing of Detection System]

Figure 4:
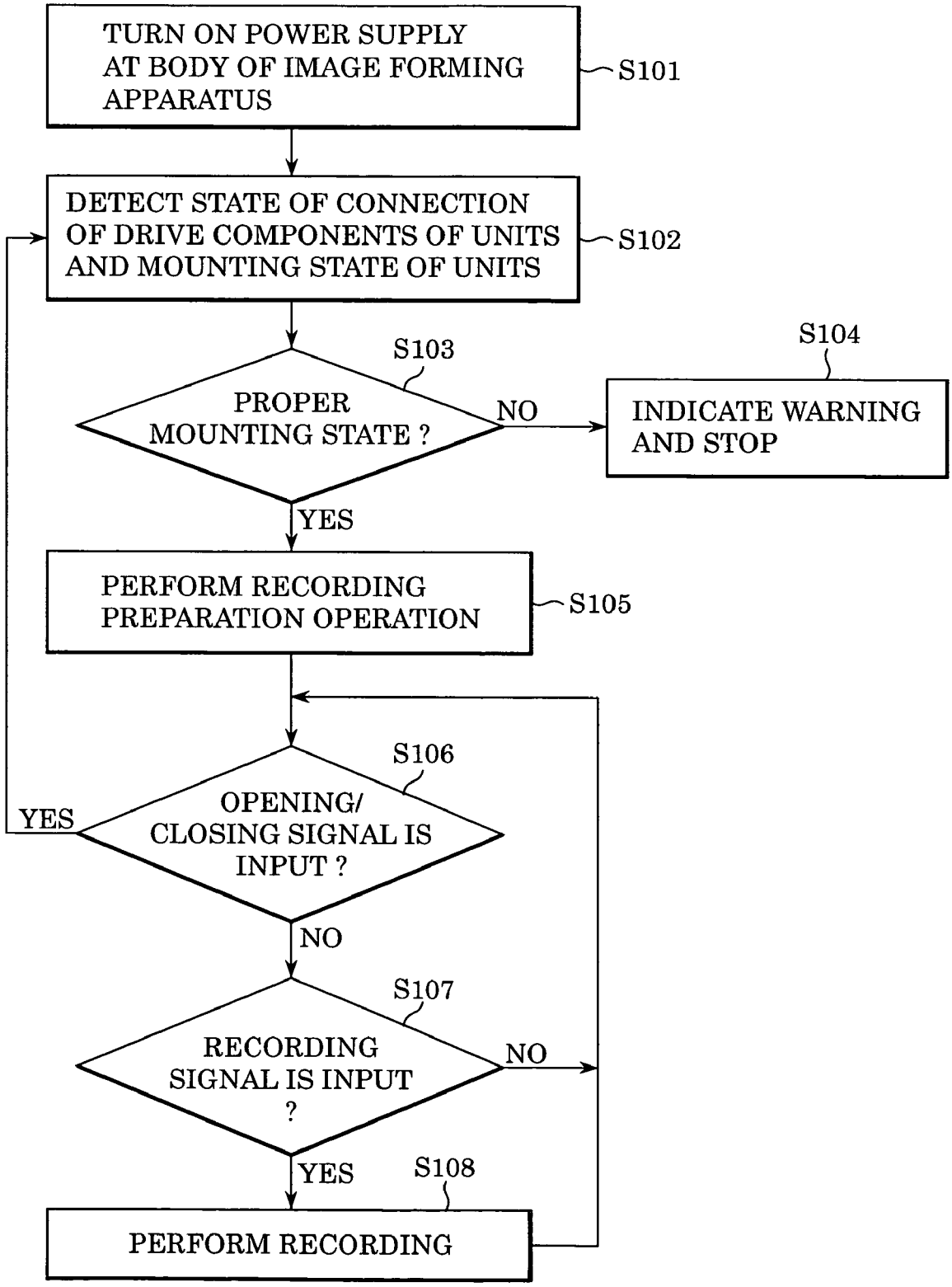
FIG. 4 is a flowchart of a detection timing of each container.

The sequence of detection operation steps will be described with reference to FIG. 4. FIG. 4 is a flowchart of the detection timing of each container, and FIGS. 12A to 12C show examples of warning displays.

The power supply of the image forming apparatus 14 is turned on in Step S101, and the mounting state of the cartridges C is detected in Step S102. As mentioned above, in the embodiment, the mounting state is detected by detecting whether or not current is flowing in the detection circuit with the detecting unit 20.

In Step S103, it is determined whether or not the drive force transmission members of the cartridges C are properly connected and the cartridges C are properly mounted. If the connection and the mounting are properly achieved, a recording preparation operation is performed in Step S105, whereas if they are not properly achieved, a warning is indicated to a user and the process is stopped in Step S104. For example, as shown in FIG. 12A, the warning can be displayed on an informing unit 300 of the image forming apparatus 14. The informing unit 300 may be provided on an operation panel of the image forming apparatus 14. The warning may also be displayed on a monitor of an external computer by sending a signal to the external computer. After the recording preparation operation, a confirmation is made as to whether or not an opening/closing signal of an opening-and-closing cover 14*a* is input to the controlling unit 200 in Step S106 and then a confirmation is made as to whether or not a recording signal for forming an image is input to the controlling unit 200 in Step S107. If the opening/closing signal of the opening-and-closing cover 14*a* is input to the controlling unit 200 in Step S106, the mounting state of the cartridges C is detected again in Step S102. If the recording signal is input to the controlling unit 200 in Step S107, after performing recording in Step S108, Steps S106 and S107 are carried out again.

The sequence of operation steps is summarized: (1) the mounting state of the cartridges C is detected when the power supply is on and when the opening-and-closing cover 14*a* is opened or closed, (2) prior to executing the recording preparation operation, the mounting state of the cartridges C is detected, and (3) when the mounting state of any of the cartridges C is improper, a warning is displayed and the process is stopped.

[Detection Circuit of Detection System]

In the detection circuit shown in FIG. 1, the resistor 20*a* has a resistance of about 50 Ω and is connected in series, and the power supply 20*b* applies a bias direct voltage of about 10 V. If all of the cartridges C are properly mounted, a current of about 0.2 A flows through the detection circuit, whereas if any one of the cartridges is not properly mounted, current does not flow through the detection circuit.

As mentioned above, each shaft 27 is electrically conductive, and forms a portion of the detection circuit CK1. Ordinarily, the inner side or base layer of each photosensitive drum 1 is metallic, and is often grounded. Therefore, even in this embodiment, switching may be performed between the detection of the mounting of the cartridges C and the grounding of the photosensitive drums 1 with a switch (not shown).

[Summary]

As mentioned above, the detecting unit 20 detects the positions of the positioning members 27*a* at the drive side of the four cartridges C as well as the positions of the positioning members 27*b* at the non-drive side of the four cartridges C. The aforementioned detection method makes it possible to detect the mounting state of each cartridge C and the connection state of each drive force transmission member 21 at the same time.

In the structure according to the embodiment, the state of connection of each drive force transmission member 21 can be achieved without actually driving them. Therefore, the detection time is short, and the drive force transmission members 21 are not damaged when the cartridges C are not properly mounted.

Other Structures of First Embodiment

Although, in the embodiment, a plurality of cartridges C serving as units are used, the present invention may be applied to one cartridge C in order to provide similar advantages. In addition, although, in the embodiment, the cartridges C are mounted to the image forming apparatus 14 in the longitudinal direction of the cartridges C (that is, in the direction of the axial lines of the drums), the cartridges C may be mounted to the image forming apparatus 14 in a direction perpendicular to the longitudinal direction of the cartridges C (that is, in a direction perpendicular to the direction of the axial lines of the drums).

Figure 13:
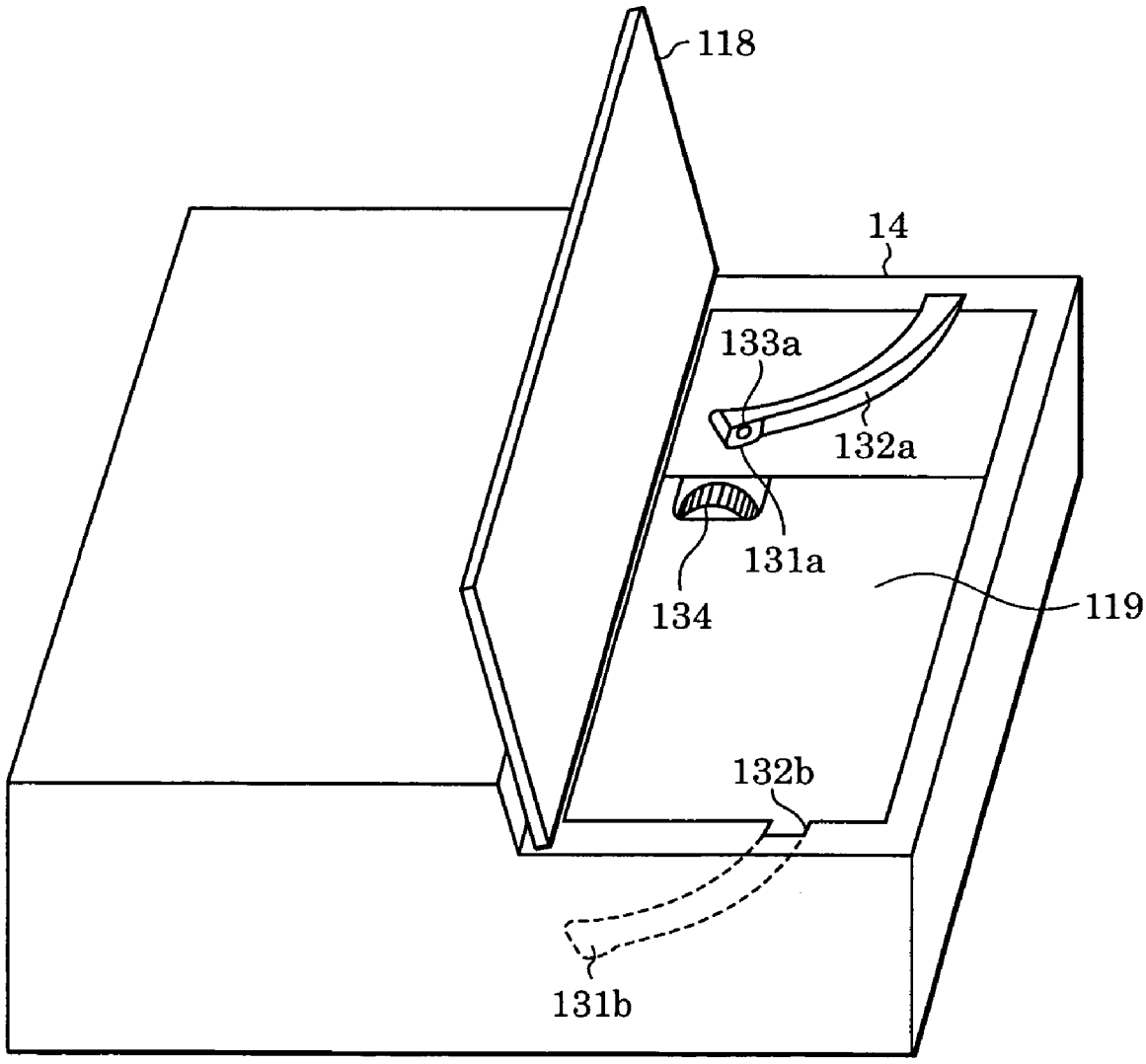
FIG. 13 shows another structure of the first embodiment.
Figure 14:
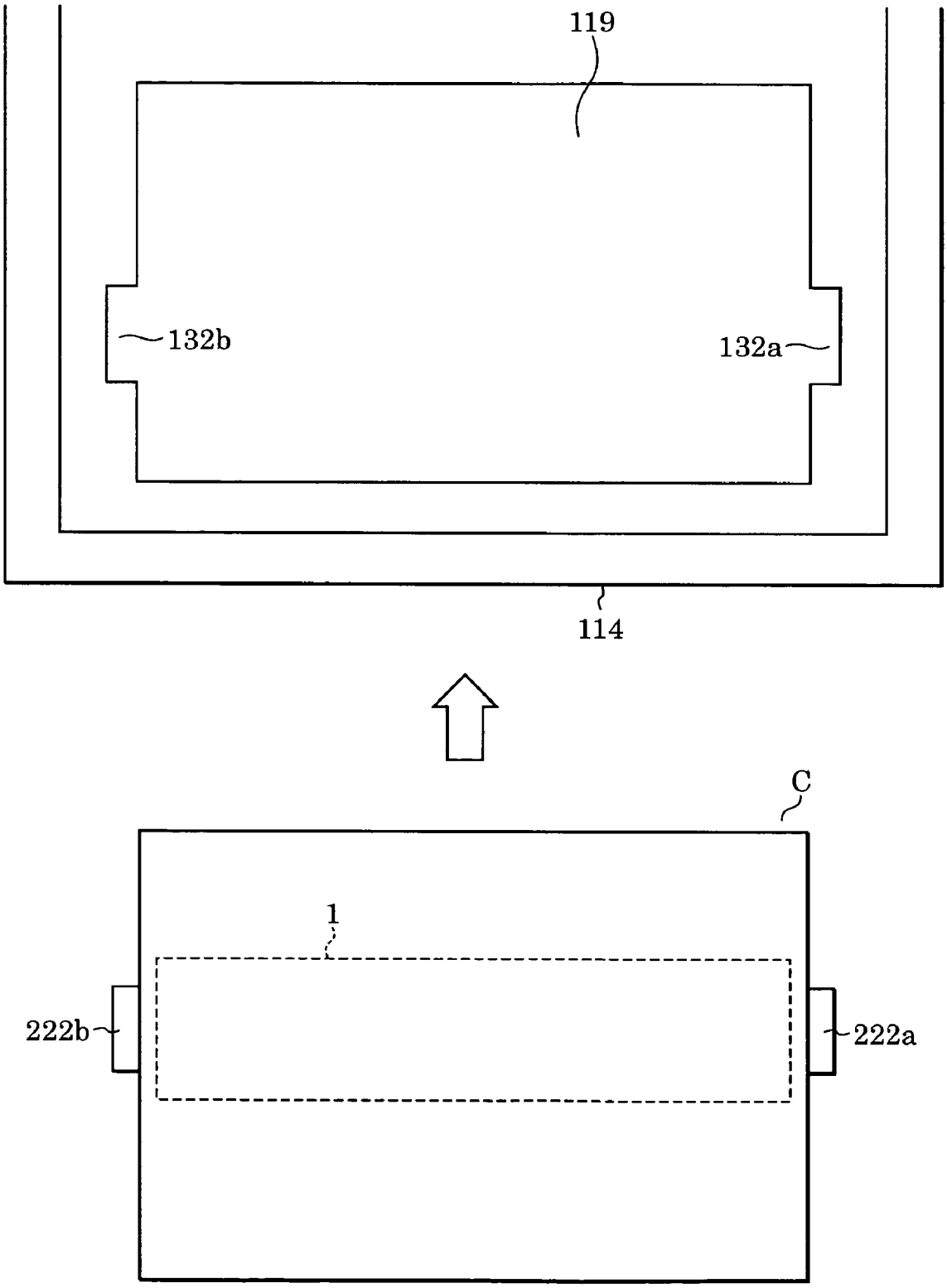
FIG. 14 shows another structure of the first embodiment.

More specifically, as shown in FIGS. 13 and 14, the image forming apparatus 14 has guides 132*a* and 132*b* for mounting a cartridge C into a body 119 in a direction perpendicular to the longitudinal direction of the cartridge C. Positioning members 222*a* and 222*b* disposed at respective ends of the cartridge C in the longitudinal direction thereof are guided by the respective guides 132*a* and 132*b*. The cartridge C is positioned in the image forming apparatus 14 by engagement of the guides 132*a* and 132*b* with the positioning members 131*a* and 131*b* at the body.

Figure 15A:
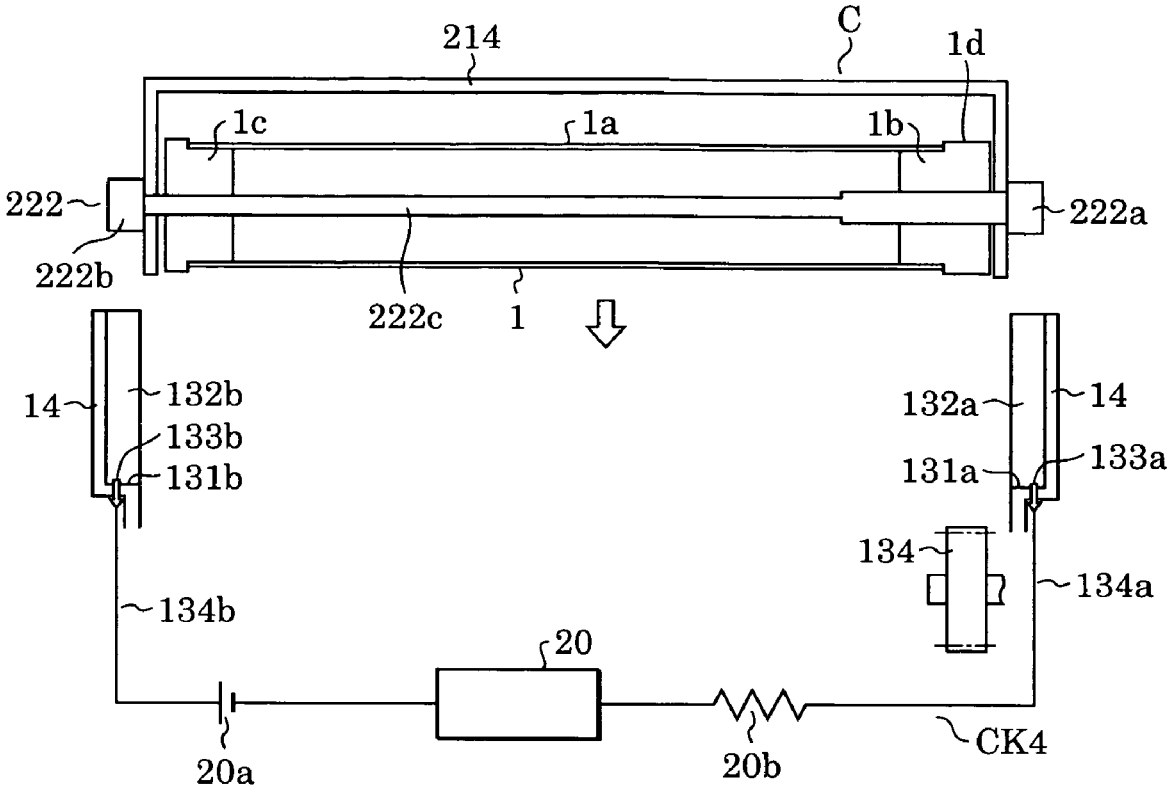
FIGS. 15A and 15B show another structure of the first embodiment.
Figure 15B:
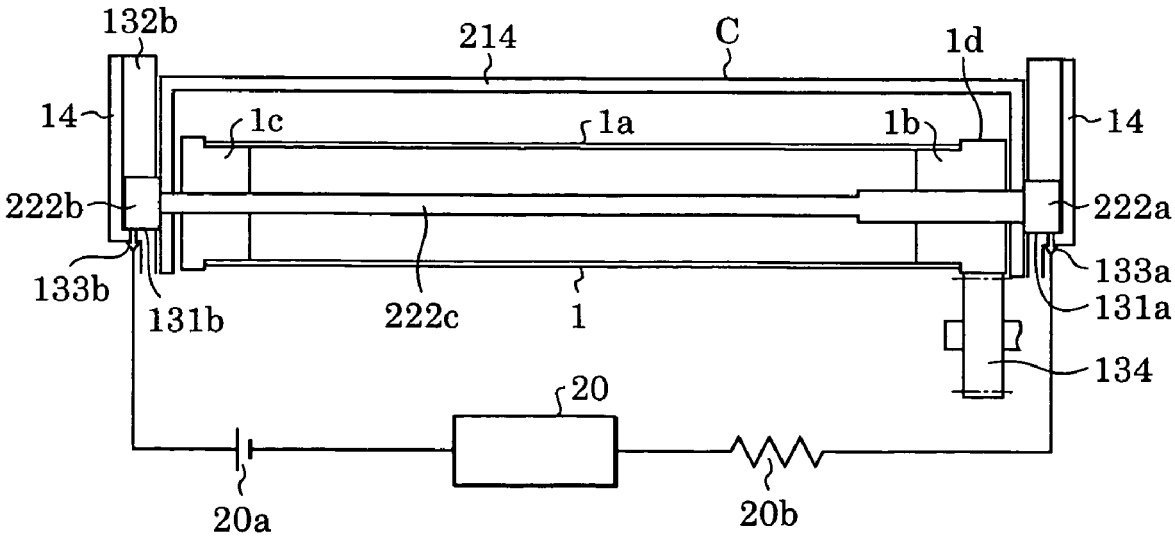

As shown in FIGS. 15A and 15B, the positioning members 222*a* and 222*b* are disposed at respective ends of a shaft 222*c*. The shaft 222*c* rotatably supports the photosensitive drum 1 at a frame 214. Here, the photosensitive drum 1 has flanges 1*b* and 1*c* fitted to respective ends of a cylinder 1*a*. The flanges 1*b* and 1*c* rotatably engage the shaft 222*c*. The positioning members 222*a* and 222*b* and the shaft 222*c* are formed of a metallic material. The positioning members 222*a* and 222*b* are electrically connected.

Body contacts 133*a* and 133*b* electrically connected to the detecting unit 20 by respective conducting members 134*a* and 134*b* are disposed at the body positioning members 131*a* and 131*b*, respectively. Therefore, when the cartridge C is mounted to the image forming apparatus 14 as shown in FIG. 15B, as in the first mentioned structure in the first embodiment, the positioning member 222*a* and the body contact 133*a* and the positioning member 222*b* and the body contact 133*b* are electrically connected. In other words, mounting the cartridge C forms a detection circuit CK4, so that proper mounting of the cartridge C to the image forming apparatus can be detected by the detecting unit 20. Here, as in the structure in the first embodiment, a drive gear 134 disposed at the image forming apparatus 14 and a drum gear id disposed at one end of the photosensitive drum 1 in the longitudinal direction thereof properly engage each other. The drum gear 1*d* receives a drive force from the drive gear 134 in order to rotate the photosensitive drum 1. Due to the above-described structure, as in the first mentioned structure of the first embodiment, the position of the positioning member 222*a* at the drive side of the cartridge C and the position of the positioning member 222*b* at the non-drive side of the cartridge C are both detected by the detecting unit 20. The aforementioned method of detection makes it possible to detect the mounting state of the cartridge C and the state of connection of the drum gear id, which is a drive force transmission member, at the same time. The state of connection of the drum gear 1*d* and the drive gear 134 can be detected without actually driving them. Therefore, the detection time is short, and the drum gear id and the drive gear 134 are prevented from being damaged when the cartridge C is not properly mounted.

Figure 5:
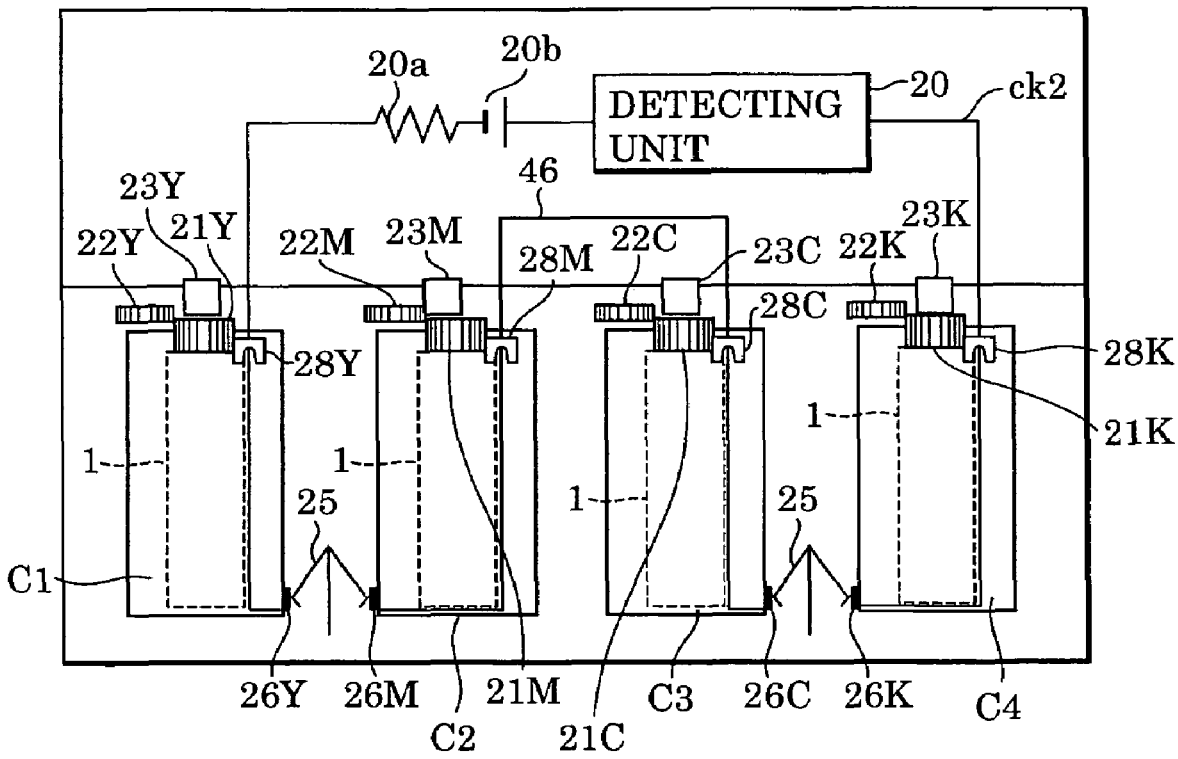
FIG. 5 is a schematic view of another detection system.

As shown in FIG. 5 and FIG. 6, first unit electrical contacts and second unit electrical contacts may be disposed at locations that do not correspond to the locations of the positioning members 27*a* and 27*b* of the cartridges, respectively.

Figure 6A:
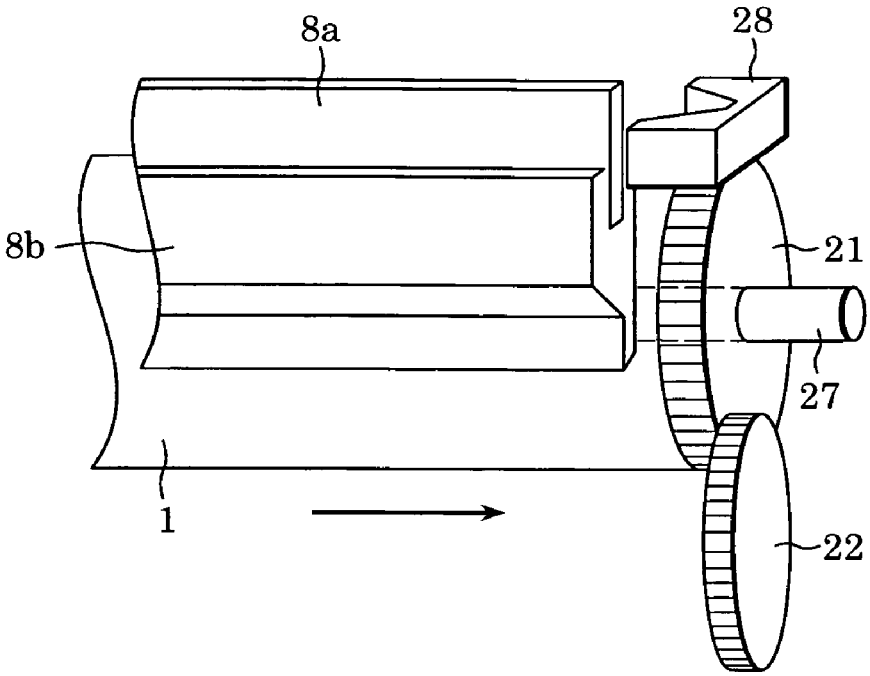
FIGS. 6A and 6B show another structure of the vicinity of the connection portion at the drive side.
Figure 6B:
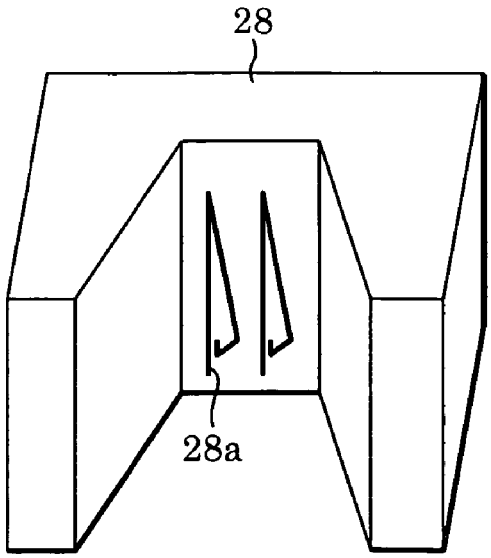

FIG. 5 is a schematic view of another structure of the detection system, and FIGS. 6A and 6B illustrate another structure of the vicinity of the connection portion at the drive side.

More specifically, as shown in FIG. 6A, in each cartridge C, a support 8*a* of a cleaning blade 8 is used as a drive-side electrical contact (that is, the first unit electrical contact). Each support 8*a* supports a resilient member 8*b* for removing toner from the peripheral surface of the photosensitive drum 1 as mentioned above. Each support 8*a* is formed of metal.

As shown in FIG. 5, electrical contacts 26 (26Y, 26M, 26C, and 26K) are disposed as the second unit electrical contacts at side surfaces of the respective cartridges C at the non-drive side thereof. The electrical contacts 26 of adjacent cartridges C are disposed so as to oppose each other. In other words, in FIG. 5, the electrical contact 26Y is disposed at the right side surface of the cartridge C1 and the electrical contact 26M is disposed at the left side surface of the cartridge C2 so as to oppose each other. The same applies to the electrical contacts 26C and 26K. A body electrical contact 25*a* disposed between the cartridges C1 and C2 electrically connects the electrical contacts 26Y and 26M. A body electrical contact 25*b* electrically connects the electrical contacts 26C and 26K.

As shown in FIG. 6B, each contact cover 28 disposed at the image forming apparatus 14 has a contact 28*a* at its inner side. Mounting the cartridges C to the image forming apparatus 14 electrically connects the supports 8*a* and the respective contacts 28*a*. According to this form, changing the positions of the electrical contacts 26 and the positions of the respective body electrical contacts 25 makes it possible to detect whether or not the cartridges C are mounted to respective predetermined locations. As in the first mentioned structure of the first embodiment, a conducting member 46 electrically connected to two adjacent electrical contacts 28*a* is disposed at the drive side of the image forming apparatus 14. Accordingly, the adjacent cartridges C2 and C3 are electrically connected by the conducting member 46. In other words, in FIG. 5, the contact covers 28Y and 28K having the respective contacts 28*a* are electrically connected in series and form a detection circuit CK3.

In the embodiment, the image forming apparatus 14 is described as having four process cartridges disposed in a straight line. However, the image forming apparatus 14 may be a rotary development type in which four development containers are secured in cylindrical containers and development operations are carried out successively while rotating the development containers 90 degrees at a time.

Second Embodiment

Figure 7A:
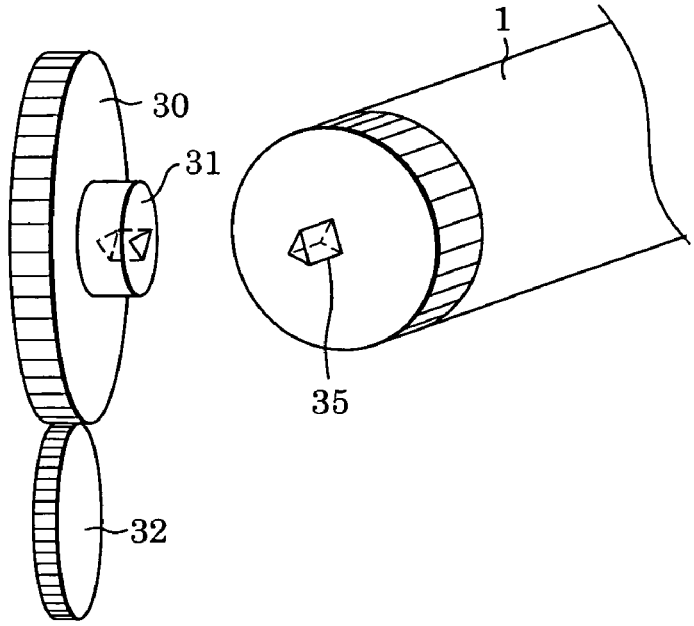
FIGS. 7A to 7C show a mounting portion of a unit in accordance with a second embodiment of the present invention.
Figure 7B:
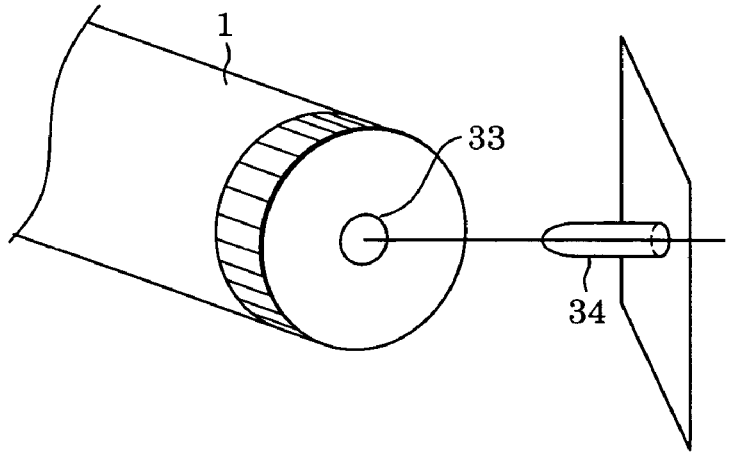
Figure 7C:
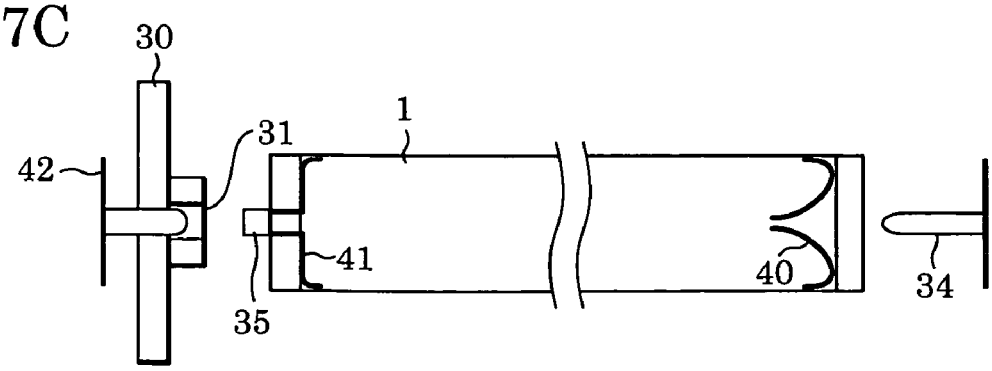
Figure 8:
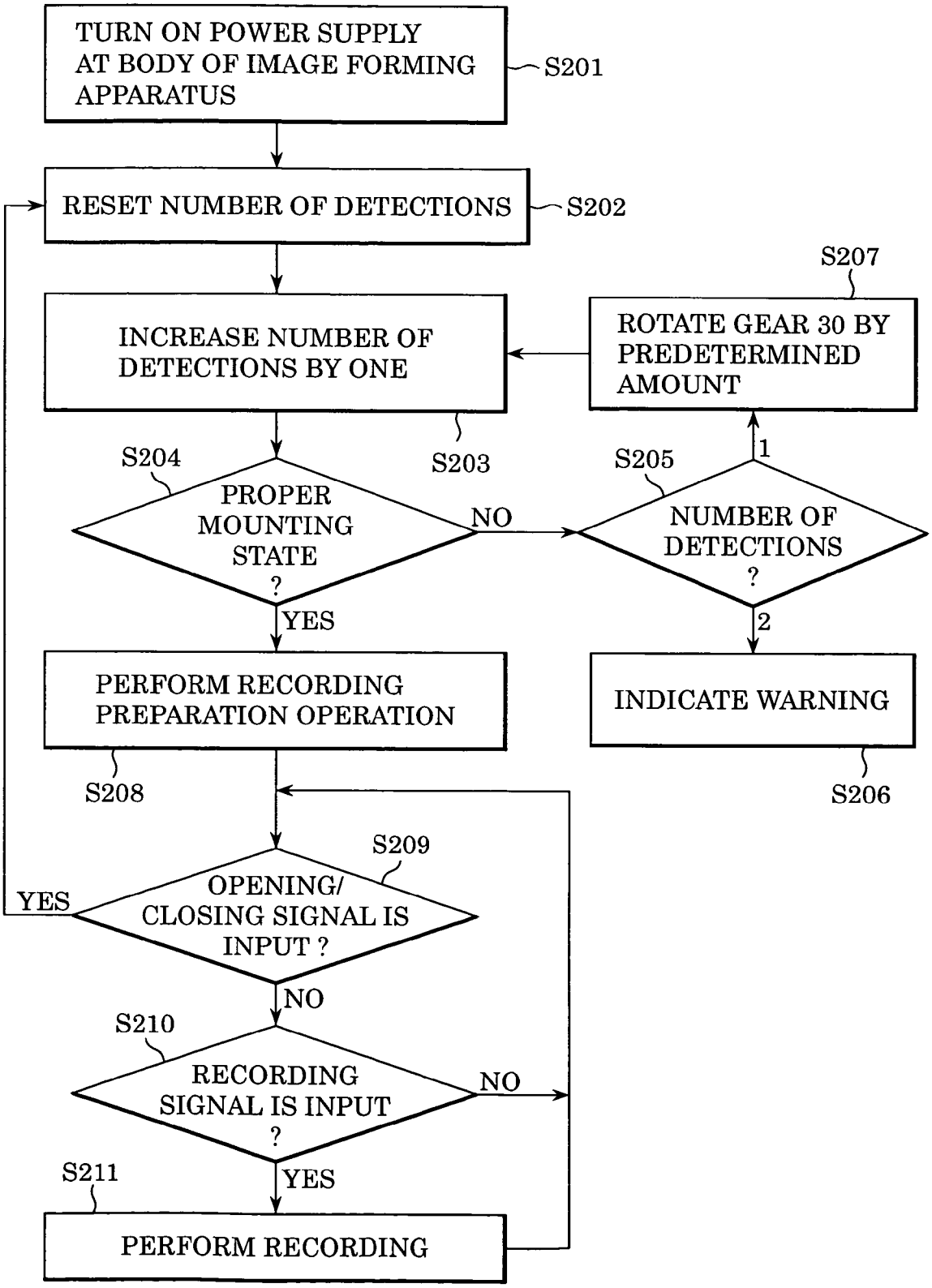
FIG. 8 is a flowchart of a detection timing of each container.

A description of a detection system, cartridges C, and an image forming apparatus according to a second embodiment of the present invention will be given. FIGS. 7A to 7C illustrate a connection portion of the cartridge C, and FIG. 8 is a flowchart of a detection timing of each container. Parts corresponding to those in the first embodiment are given the same reference numerals, and the same descriptions of these corresponding parts will not be described below. The second embodiment differs from the first embodiment in its drive transmission structure. As a result, the contact structure in the second embodiment also differs from that in the first embodiment.

[General Description of Drive Transmission Structure]

In the second embodiment, a driving unit has a coupling structure as shown in FIGS. 7A to 7C. FIG. 7A shows the drive-side structure. Gears 30 and 32 are disposed as the driving unit at an image forming apparatus 14. A drive force from a drive motor (not shown) is transmitted to the gear 30 via the gear 32. A recess 31, which is triangular in cross section, is integrally formed with the central portion of the gear 30. A protrusion 35, which is triangular in cross section, is formed at the central portion of an end of a photosensitive drum 1 of the associated cartridge C. Connecting the protrusion 35 and the recess 31 determines the position of the center of rotation, and, at the same time, allows the protrusion 35 to receive the drive force from the gear 30.

FIG. 7B shows the non-drive side structure. At the non-drive side, a recess 33 is formed at an end of the photosensitive drum 1. Connecting the recess 33 with a body protrusion 34 causes the center of rotation to be positioned.

[Description Related to Contacts of Detection System]

An electrical contact structure in the embodiment will be described with reference to FIG. 7C. A metallic plate 41 connected to the protrusion 35 is disposed at the drive side in the photosensitive drum 1, and is in contact with the inside wall of a cylinder of the photosensitive drum 1. A metallic conducting member 42 passes through the central portion of the gear 30. When the recess 31 and the protrusion 35 are connected, the protrusion 35, serving as an electrical contact, and the conducting member 42 are in contact with each other.

At the non-drive side, a metallic plate 40 is disposed at the inner side of the recess of the photosensitive drum 1, and is in contact with the inner wall of the cylinder of the photosensitive drum 1. Therefore, when the protrusion 34 is inserted in the recess 33 of the photosensitive drum 1, the metallic plate 40 and the protrusion 34 serving as an electrical contact are in contact with each other. The inside wall of the photosensitive drum 1 is formed of electrically conductive aluminum, and is always in electrical conduction with the metallic plates 40 and 41.

[Detection Timing of Detection System]

The sequence of detection operation steps in the embodiment will be described with reference to FIG. 8. In the embodiment, since the recesses 33 and the respective protrusions 34 are triangular in cross section, if the recesses 33 and the respective protrusions 34 are not set in the proper orientation, the recesses 33 and the respective protrusions 34 are not fitted together.

A drive force can be transmitted to the photosensitive drum 1 by setting the recesses 31 and 35 in the proper orientation and fitting them together by rotating the gear 30 by a predetermined amount. Therefore, the sequence of the detection operation steps is slightly different from that in the first embodiment.

The primary difference is in the sequence of the steps carried out when a detection is made that at least one of the cartridges C is not properly mounted.

When a power supply of the image forming apparatus 14 is turned on in Step S201, the number of detections stored in a storing unit (not shown) of the image forming apparatus 14 is reset to 0 in Step S202. Then, after increasing the number of detections of the mounting state of the cartridges C by one in Step S203, a determination is made as to whether or not the cartridges C are properly mounted in Step S204.

If it is determined that any one of the cartridges C is not properly mounted in Step S204, the number of detections is confirmed in Step S205. If the detection is a first detection, the gears 30 are rotated by a predetermined amount in Step S207. This is because the recesses 31 and the respective protrusions 35 may not be properly orientated. Thereafter, the number of detections is increased by one again in Step S203 in order to determine whether or not the cartridges C are properly mounted in Step S204. If any one of the cartridges C is not properly mounted, the number of detections is confirmed in Step S205. If the detection is a second detection, a warning is displayed to a user in Step S206.

If the cartridges C are properly mounted, a recording preparation operation is carried out in Step S208. Then, a confirmation is made as to whether or not an opening/closing signal of an opening-and-closing cover 14*a* is input to a controlling unit 200 in Step S209, and a confirmation is made as to whether or not a recording signal for forming an image is input to the controlling unit 200 in Step S210. If the opening/closing signal of the opening-and-closing cover 14*a* is input to the controlling unit 200 in Step S209, the number of detections is reset in Step S202. Then, the mounting state of the cartridges C is detected again in Step S203. If the recording signal is input to the controlling unit 200 in Step S210, a recording operation is carried out in Step S211. Then, Steps S209 and S210 are repeated.

The flow of the sequence of the detection operation steps is such that: (1) it is basically the same as that in the first embodiment, but differs when the detection result is abnormal, and (2) detection is executed again after carrying out Step S207 once when the detection result is not normal. In other words, the gears 30 are rotated by a predetermined amount in accordance with the detection result of the detection system. This is because, if the gears 30 are not rotated by a predetermined amount, the recesses 31 and the respective protrusions 35 may not be properly oriented.

[Speeding up of Mounting by Detection System]

Finally, the operation carried out in Step S207 will be described. The recesses 31 and the respective protrusions 35 may not be fitted together unless the respective gears 30 are slightly rotated. Therefore, in the second embodiment, the drive gears 30 are rotated once at a speed that is half that when an image is being formed.

The speed of the drive gears 30 is slow in order to reliably fit the recesses 31 and their respective protrusions 35 together when they are not properly oriented. The drive gears 30 are rotated once in order to increase the frequency with which the recesses 31 and their respective protrusions 35 are properly oriented. The cross sectional shapes of the recesses 31 and protrusions 35 match at the positive side.

The speed and rotational speed are not limited to these values. However, from the viewpoint of not depleting the cartridges C themselves, the rotational speed should be small.

[Summary]

As described above, even if the transmission of a drive force is achieved by coupling connection, that is, by connecting the recesses 31 and the protrusions, the connection state and the mounting state of the four process cartridges can be detected at the same time.

Third Embodiment

Figure 9:
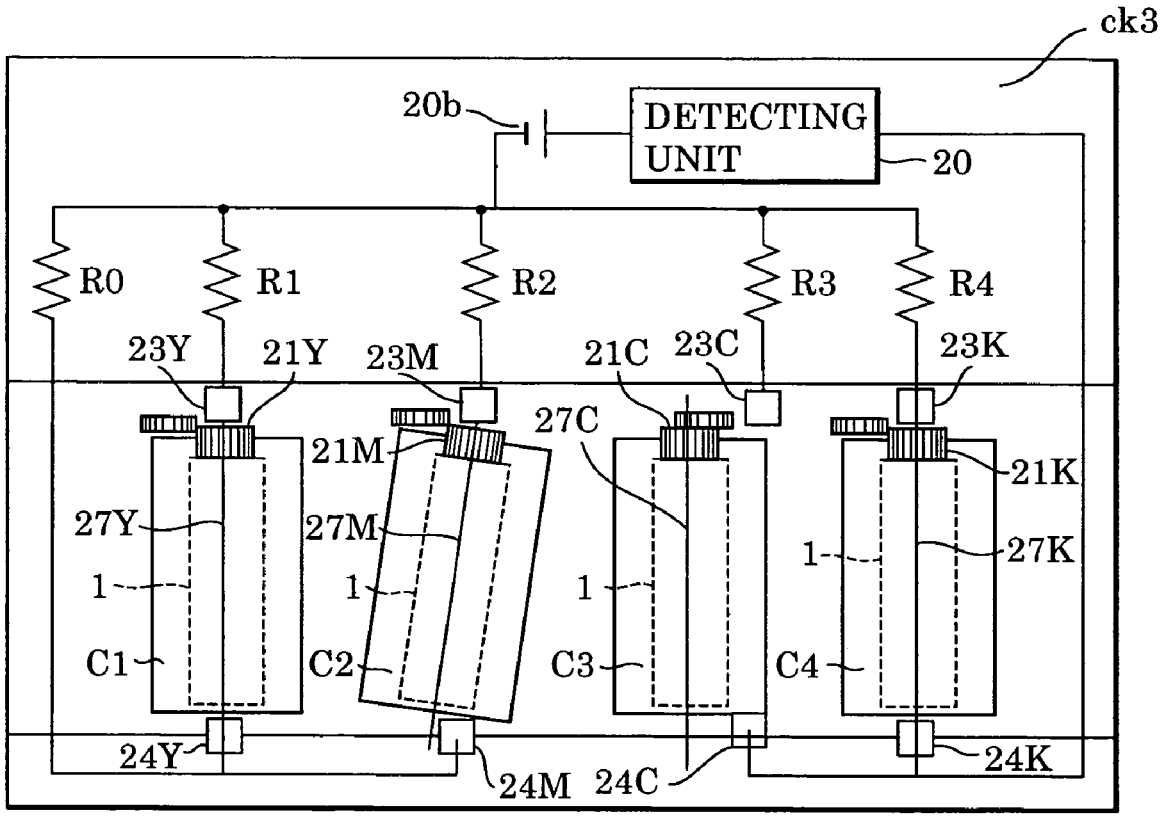
FIG. 9 schematically shows a structure of a detection system in accordance with a third embodiment of the present invention.

An image forming apparatus, cartridges C, and a detection system in accordance with a third embodiment of the present invention will be described. FIG. 9 schematically shows a structure of the detection system in accordance with a third embodiment of the present invention. FIG. 10 shows examples of resistance values, applied voltage values, and detection current values.

Parts corresponding to those in the first embodiment are given the same reference numerals, and the same descriptions thereof will not be given below. The structure and the operation of the third embodiment are the same as those of the first and second embodiments, except that the mounting states of the cartridges C can be detected one at a time and that a detection circuit and a method of detection are different.

In the first and second embodiments, it is only possible to detect a state in which all of the four cartridges C are properly mounted to the image forming apparatus 14. In other words, when the mounting is improper, it is not possible to detect which cartridge or cartridges C are not properly mounted. Therefore, although the structures in the first and second embodiments are practical, it is desirable to know which cartridge or cartridges C are not properly mounted considering the usability of the image forming apparatus by a user.

[General Description of Detection of Mounting State and Connection of Driving Components of Each Cartridge C]

As shown in FIG. 9, in a detection system circuit according to the third embodiment, a reference resistor R0 and cartridges C1 to C4 for respective colors are connected in parallel, and the cartridges C1 to C4 and resistors R1 to R4 having different resistances are connected in series. The reference resistor R0 is provided for stabilizing a circuit CK3 when none of the cartridges C are connected.

By virtue of such a structure, when the cartridges C1 to C4 are connected, the resistors R1 to R4 to which the respective cartridges C1 to C4 are connected in series are connected in parallel in the circuit. The combined resistance of the detection circuit CK3 as a whole varies. Therefore, measuring a detection current amount makes it possible to determine which cartridge or cartridges C are properly mounted and which cartridge or cartridges are not properly mounted.

[Details of Detecting Operation of Mounting State of Each Cartridge C]

FIG. 10 shows specific examples of resistance values, applied voltage values, and detection current values. As shown in the table, the applied voltage is 50 V, the resistance of the resistor R1 connected in series with the cartridge C1 is 10 Ω, the resistance of the resistor R2 connected in series with the cartridge C2 is 20 Ω, the resistance of the resistor R3 connected in series with the cartridge C3 is 40 Ω, the resistance of the resistor R4 connected in series with the cartridge C4 is 80 Ω, and the resistance of the resistor R0 not connected in series with any of the cartridges C is 160 Ω.

There are a total of 16 mounting states for the four cartridges C. State 1 is a state in which none of the four cartridges C are properly mounted, and State 16 is a state in which all four of the cartridges C are properly mounted. The current values of all of the states are different. Therefore, detection of the current value makes it possible to precisely detect which cartridge or cartridges C are properly and not properly mounted. Consequently, as shown by, for example, a warning display in FIG. 12B, it is possible to indicate to the user which cartridge C is not properly mounted.

[Summary]

As described above, in the embodiment, the cartridges C are connected in parallel in the detection circuit CK3, and an electrical load in a parallel circuit including its associated cartridge C is set to a certain value. Therefore, it is possible to vary each electrical load in accordance with the mounting state. Consequently, it is possible to detect whether or not each cartridge C is properly mounted by the electrical current value. When the mounting state of each cartridge C is detected, whether or not a drive force transmission member 23 of each cartridge C is properly connected is detected.

Other Structures of Third Embodiment

Figure 11A:
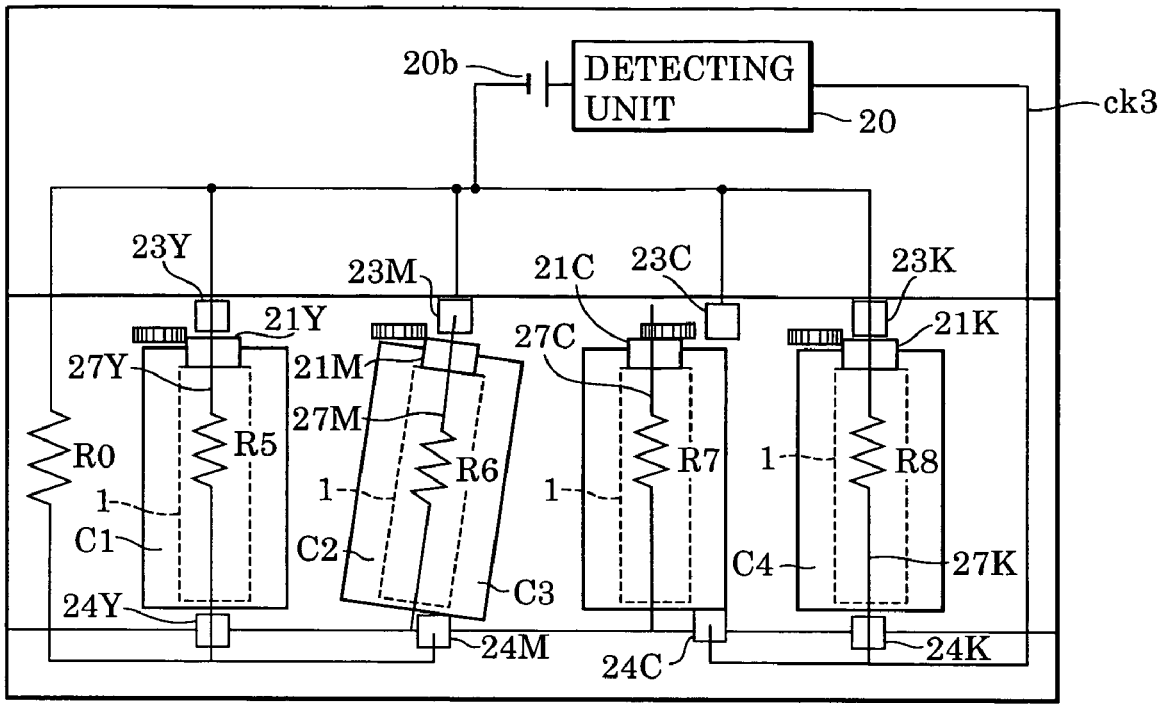
FIGS. 11A and 11B are schematic views of another structure of the detection system.

In the image forming apparatus according to the third embodiment, the cartridges C1 to C4 are described as being connected to the resistors in series. As shown in FIG. 11A, resistors R5 to R8 having different resistances may be disposed in the respective cartridges in accordance with the types of colors.

Figure 11B:
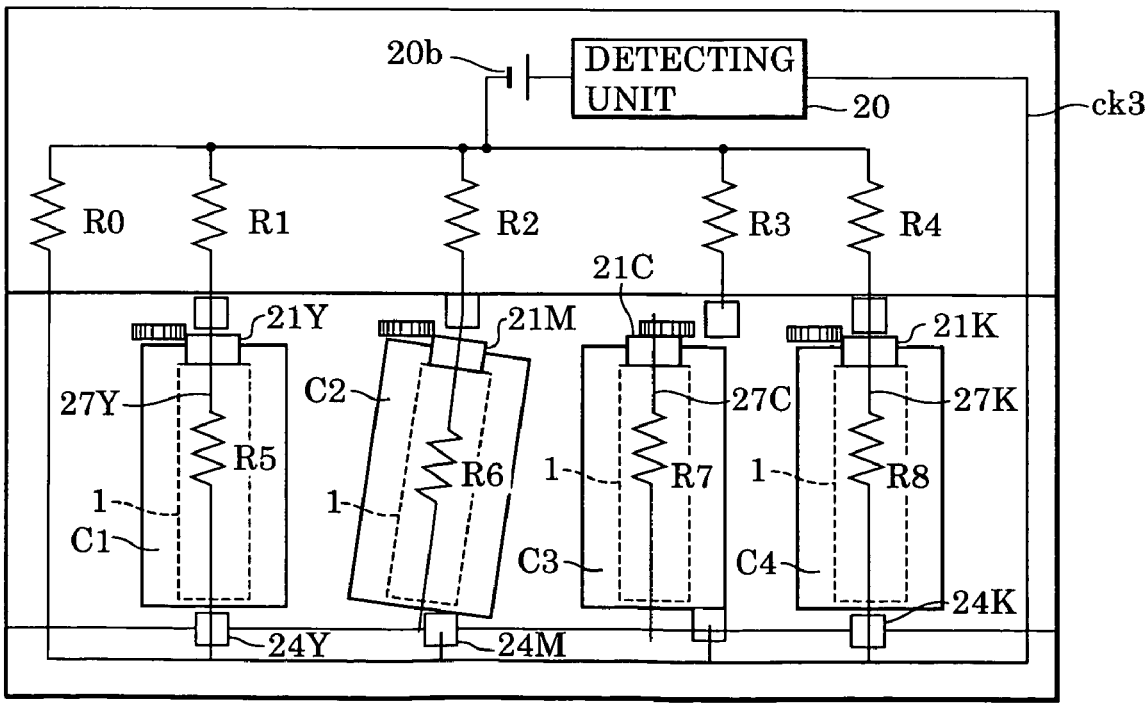

In addition, as shown in FIG. 11B, resistors may be provided at both the image forming apparatus and the cartridges C1 to C4. In this case, by making the resistance values of the nine resistors different (so that, in particular, the total series resistance at the body and the total series resistance at the cartridges are not the same), it is possible to detect which cartridge is mounted to which portion of the body. Therefore, it is possible to prevent improper mounting of the cartridges C. Consequently, for example, a warning display shown in FIG. 12C can further indicate to the user which cartridge C is not properly mounted.

According to the present invention, it is possible to detect that a unit is properly mounted to the body of an electrophotographic image forming apparatus by a simple structure. In addition, it is possible to detect whether or not a drive member at the apparatus body and a drive force transmission member at the unit are properly engaged by the detection of the mounting state of the unit.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-176468 filed Jun. 15, 2004, and priority from Japanese Patent Application No. 2005-156876 filed May 30, 2005 which are hereby incorporated by reference herein.

What is claimed is:

1. A unit removably mounted to an electrophotographic image forming apparatus operable to form an image on a recording medium, the unit comprising:

a drive force transmission member configured to engage with a body drive member of the apparatus in order to facilitate transmitting a drive force to the unit from the body drive member;

a first positioning member provided at a first end of the unit in a longitudinal direction thereof and facilitating positioning the unit to the apparatus when the unit is to be mounted to the apparatus;

a first unit electrical contact provided at the first end, the first unit electrical contact electrically connecting with a first body electrical contact of the apparatus when the first positioning member is mounted to the apparatus;

a second positioning member provided at a second end in the longitudinal direction thereof and facilitating positioning the unit to the apparatus when the unit is to be mounted to the apparatus; and a second unit electrical contact provided at the second end and electrically connected with the first unit electrical contact, the second unit electrical contact electrically connecting with a second body electrical contact of the apparatus when the second positioning member is mounted to the apparatus, wherein an electrical connection state between the first unit electrical contact and the second unit electrical contact is detected through the first body electrical contact and the second body electrical contact with a body detecting unit of the apparatus.

2. The unit according to claim 1, wherein the first unit electrical contact is disposed at the first positioning member, and the second unit electrical contact is disposed at the second positioning member.

3. The unit according to claim 2, further comprising an electrophotographic photosensitive drum, wherein the first positioning member and the second positioning member are protrusions coaxially disposed with an axial line of the electrophotographic photosensitive drum.

4. The unit according to claim 3, further comprising a penetration shaft penetrating through the electrophotographic photosensitive drum and being electrically conductive, the penetration shaft having the first positioning member at the first end and the second positioning member at the second end.

5. The unit according to claim 1, further comprising an electrophotographic photosensitive drum, wherein the first positioning member and the second positioning member are protrusions coaxially disposed with an axial line of the electrophotographic photosensitive drum.

6. The unit according to claim 5, further comprising a penetration shaft penetrating through the electrophotographic photosensitive drum and being electrically conductive, the penetration shaft having the first positioning member at the first end and the second positioning member at the second end.

7. An electrophotographic image forming apparatus from which a unit is removably mounted, the apparatus being operable to form an image on a recording medium, the apparatus comprising:

(i) a first body electrical contact;

(ii) a second body electrical contact;

(iii) a body drive member transmitting a drive force to the unit;

(iv) a first body positioning member positioning the unit with respect to the apparatus;

(v) a second positioning member positioning the unit with respect to the apparatus;

(vi) a mounting member configured to removably mount the unit which includes a drive force transmission member, a first positioning member, a first unit electrical contact, a second positioning member, and a second unit electrical contact, the drive force transmission member transmitting a drive force to the unit from the body drive member as a result of engagement of the drive force transmission member with the body drive member, the first positioning member being provided at a first end of the unit in a longitudinal direction thereof and positioning the unit with respect to the apparatus when the unit is mounted to the apparatus, the first unit electrical contact being provided at the first end and electrically connected with the first body electrical contact when the first positioning member is positioned at the apparatus, the second positioning member being disposed at a second end of the unit in the longitudinal direction thereof and positioning the unit at the apparatus when the unit is mounted to the apparatus, the second unit electrical contact being provided at the second end and electrically connecting with the first unit electrical contact, the second unit electrical contact electrically connecting with the second body electrical contact when the second positioning member is positioned at the apparatus; and (vii) a body detecting member detecting that the unit is mounted to the apparatus by detecting an electrical connection state between the first unit electrical contact and the second unit electrical contact through the first body electrical contact and the second body electrical contact.

8. The electrophotographic image forming apparatus according to claim 7, wherein the apparatus is a color electrophotographic image forming apparatus from which a plurality of the units are removably mounted, the apparatus comprising a plurality of the first body electrical contacts, a plurality of the second body electrical contacts, and a conducting member defining a series circuit with the body detecting member through the plurality of the units when all of the units are mounted to the apparatus.

9. The electrophotographic image forming apparatus according to claim 8, wherein the conducting member comprises a first conducting portion connecting the first body electrical contacts that are adjacent to each other and a second conducting portion connecting the second body electrical contacts that are adjacent to each other.

10. The electrophotographic image forming apparatus according to claim 7, wherein the apparatus is a color electrophotographic image forming apparatus from which a plurality of the units are removably mounted, the apparatus comprising a plurality of the first body electrical contacts, a plurality of the second body electrical contacts, and a conducting member defining a parallel circuit with the body detecting member through the plurality of the units when all of the units are mounted to the apparatus.

11. The electrophotographic image forming apparatus according to claim 10, further comprising resistors having different resistance values and electrically connecting a plurality of the first unit electrical contacts with a plurality of the second unit electrical contacts of the plurality of the units.

12. The electrophotographic image forming apparatus according to claim 11, wherein the resistors electrically connect the body detecting member with the plurality of the first body electrical contacts.

13. The electrophotographic image forming apparatus according to claim 11, wherein the resistors electrically connect the body detecting member with the plurality of the second body electrical contacts.

14. The electrophotographic image forming apparatus according to claim 10, further comprising resistors having different resistance values and electrically connecting the body detecting member with the plurality of the first body electrical contacts.

15. The electrophotographic image forming apparatus according to claim 10, further comprising resistors having different resistance values and electrically connecting the body detecting member with the plurality of the second body electrical contacts.

16. The electrophotographic image forming apparatus according to claim 7, further comprising an informing member informing about a mounting state of the unit with respect to the apparatus.

* * * * *